US008344273B2

(12) United States Patent
Shi et al.

(10) Patent No.: US 8,344,273 B2
(45) Date of Patent: Jan. 1, 2013

(54) KEYBOARD STRUCTURE AND ELECTRONIC DEVICE USING THE SAME

(75) Inventors: Zheng Shi, Shenzhen (CN); Chih-Chiang Chang, Taipei Hsien (TW)

(73) Assignees: Shenzhen Futaihong Precision Industry Co., Ltd., Shenzhen (CN); FIH (Hong Kong) Limited, Kowloon (HK)

( * ) Notice: Subject to any disclaimer, the term of this patent is extended or adjusted under 35 U.S.C. 154(b) by 898 days.

(21) Appl. No.: 12/467,377

(22) Filed: May 18, 2009

(65) Prior Publication Data

US 2009/0289817 A1 Nov. 26, 2009

(30) Foreign Application Priority Data

May 21, 2008 (CN) ..... 2008 1 0301694

(51) Int. Cl.
*H01H 9/26* (2006.01)

(52) U.S. Cl. ..... 200/5 A

(58) Field of Classification Search ..... 200/5 A, 200/302.1, 512, 517; 341/22; 345/169, 168
See application file for complete search history.

(56) References Cited

U.S. PATENT DOCUMENTS

| | | | | |
|---|---|---|---|---|
| 5,146,615 | A * | 9/1992 | Hodsdon et al. | 455/90.3 |
| 6,718,188 | B1 | 4/2004 | Ohira et al. | |
| 8,046,032 | B2 * | 10/2011 | Babella | 455/575.1 |
| 8,124,894 | B2 * | 2/2012 | Yasui | 200/5 A |
| 2009/0167570 | A1 * | 7/2009 | Lin | 341/22 |
| 2010/0012472 | A1 * | 1/2010 | Yang et al. | 200/302.1 |

* cited by examiner

*Primary Examiner* — Edwin A. Leon
(74) *Attorney, Agent, or Firm* — Altis Law Group, Inc.

(57) ABSTRACT

A keyboard structure includes a housing having at least one post, a key assembly, and at least one connecting part. The key assembly includes a number of keypads and a keymat, the keymat defining a first through hole, a second through hole and a groove. The connecting part includes a ring, a protruding post and a connecting portion connecting the protruding post to the ring, the connecting part received in the first through hole, the second through hole and the groove, and then fixed on the keymat. The post passes through the key assembly and the ring coils around the post to connect the key assembly to the housing.

15 Claims, 2 Drawing Sheets

KEYBOARD STRUCTURE AND ELECTRONIC DEVICE USING THE SAME

BACKGROUND

1. Technical Field

The present invention relates to keyboard structures and, particularly, to a keyboard structure used in electronic devices.

2. Description of Related Art

With rapid development of information technology, electronic devices, such as cellular phones, personal digital assistant (PDA), etc., are becoming even more popular. Consequently, users demand more than simply basic functions, such as Internet access and send/receive email. Users can use a keyboard structure to realize above-mentioned functions.

A typical keyboard structure often includes a housing, a keymat and a plurality of keypads mounted on the keymat. The housing defines a plurality of latching slots therein. The keymat has a plurality of clasps configured for latching into the latching slots. However, the size of the latching slots can be difficult to control and manufacture. The size of the latching slots may be manufactured bigger or smaller. Therefore, the clasps can not accurately mate with the latching slots.

Therefore, there is a room for improvement within the art.

BRIEF DESCRIPTION OF THE DRAWINGS

Many aspects of the keyboard structure can be better understood with reference to the following drawings. The components in the drawings are not necessarily to scale, the emphasis instead being placed upon clearly illustrating the principles of the present keyboard structure. Moreover, in the drawings, like reference numerals designate corresponding parts throughout the several views.

DETAILED DESCRIPTION OF THE EMBODIMENTS

Figure 1:
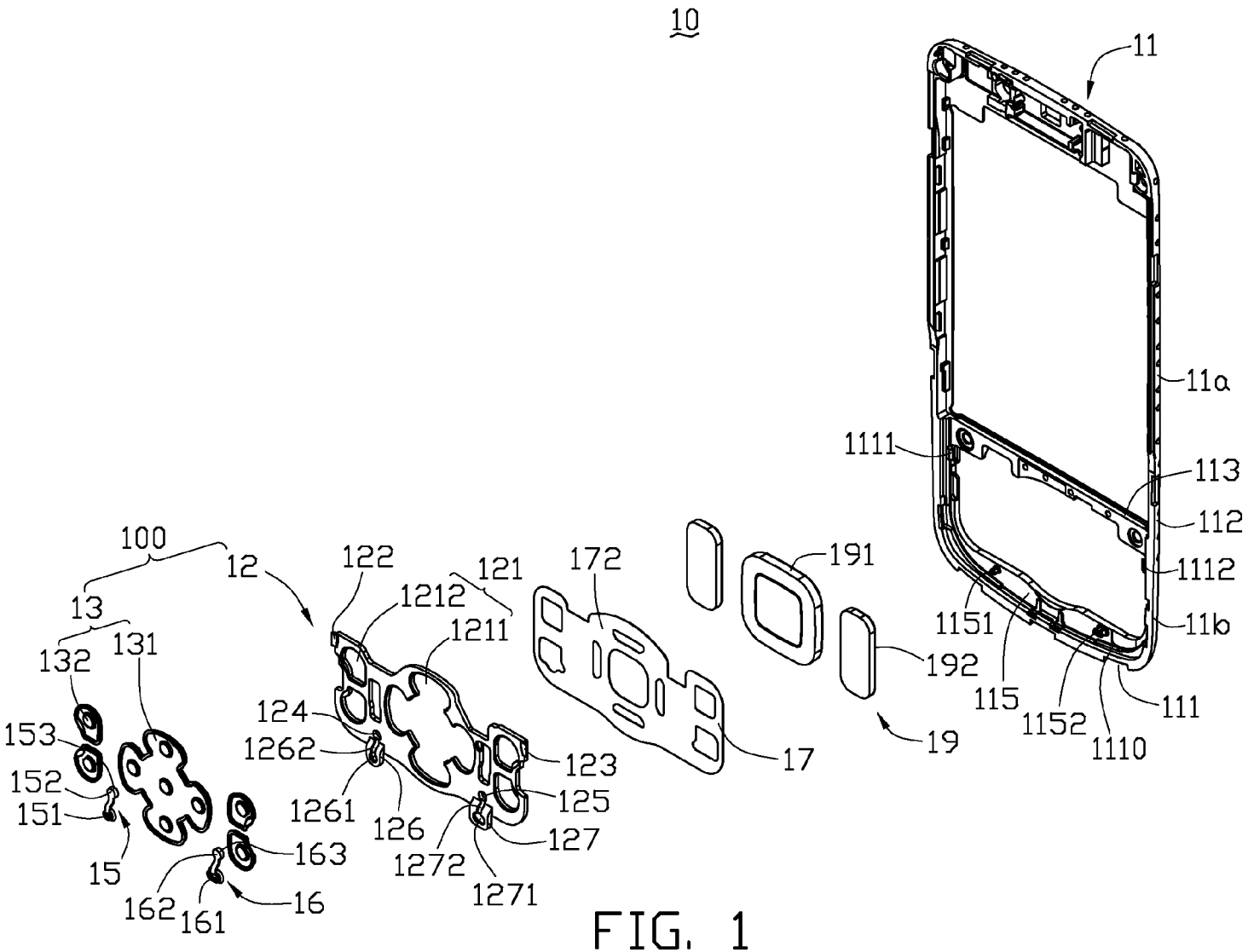
FIG. 1 is an exploded view of a keyboard structure in according with an exemplary embodiment.

Referring to the drawings, FIG. 1, shows a keyboard structure 10, applied in a portable electronic device such as a mobile phone and configured for inputting information. The keyboard structure 10 includes a housing 11, a keymat 12, a plurality of keypads 13, a first connecting part 15, a second connecting part 16, a cushion 17, and a plurality of key bodies 19.

The housing 11 is a frame of the portable electronic device. The housing 11 includes two opposite end walls 111, two opposite sidewalls 112 respectively connecting to the end walls 111, an arm 113 positioned between the two opposite end walls 111 and connecting to the two opposite sidewalls 112, a fixing board 115 perpendicularly extending from one of the end walls 111, a first post 1151 and a second post 1152. The arm 113 divides the housing 11 into a first frame portion 11*a* and a second frame portion 11*b*. The first frame portion 11*a* is configured for receiving a circuit board, a liquid crystal display (LCD) etc (none shown). The second frame portion 11*b* receives the keymat 12. The first post 1151 and the second post 1152 extend from the fixing board 115. Surfaces of the first post 1151 and the second post 1152 are roughened for increasing friction coefficient. The first post 1151 is substantially cylindrical. The second post 1152 can be an oval post.

The second frame portion 11*b* defines a first slot 1111 and a second slot 1112 adjacent to the arm 113.

The keymat 12 defines a fitting portion 121, a first through hole 124, and a second through hole 125. The fitting portion 121 includes a first hole 1211 and a plurality of second holes 1212 symmetrically defined at two sides of the first hole 1211. The first through hole 124 and the second through hole 125 are defined near an edge of the keymat 12. The keymat 12 includes a first clasp 122, a second clasp 123, a first protrusion 126, and a second the protrusion 127. The first clasp 122 and the second clasp 123 are positioned at opposite ends of the keymat 12. The first clasp 122 and the second clasp 123 are configured for correspondingly latching to the first slot 1111 and the second slot 1112. The first protrusion 126 and the second protrusion 127 extend from a same lateral side of the keymat 12 and are spaced from each other. The first protrusion 126 and the second the protrusion 127 respectively define a third through hole 1261, a first groove 1262 and a fourth through hole 1271, a second groove 1272. The first groove 1262 connects the first through hole 124 to the third through hole 1261. The second groove 1272 connects the second through hole 125 to the fourth through hole 1271.

The keypads 13 can be made of elastic material, such as rubber, silicone, etc. The keypads 13 include a first keypad 131 and a plurality of second keypads 132. The keypads 13 are engagable in the fitting portion 121.

The first connecting part 15 includes a first ring 151, a first connecting portion 152, and a first protruding post 153. The first connecting portion 152 connects the first ring 151 to the first protruding post 153. The first ring 151 can be made of elastic material, such as rubber or silicone etc., and matchable into the third through hole 1261. The first protruding post 153 can be made of elastic material, such as rubber or silicone etc., and matchable into the first through hole 124.

The first connecting part 15 is received in the first through hole 124, the first groove 1262 and the third through hole 1261, and attached to the keymat 12. The first ring 151 is received in the third through hole 1261 and further coils around the first post 1151 of the housing 11. The diameter of the first ring 151 is slightly less than that of the first post 1151. Therefore, the first ring 151 tightly coils around the first post 1151. The first connecting portion 152 and the first protruding post 153 are respectively received in the first groove 1262 and the first through hole 124. The diameter of the first protruding post 153 is slightly larger than that of the first through hole 124. Therefore, the first protruding post 153 tightly engages into the first through hole 124.

The second connecting part 16 includes a second ring 161, a second connecting portion 162, and a second protruding post 163. The second connecting part 16 tightly engages in the second through hole 125, the second the protrusion 127 and the fourth through hole 1271.

The cushion 17 can be made of elastic material, such as rubber or silicone etc. The cushion 17 has a plurality of press portions 172 corresponding to the fitting portion 121. The cushion 17 is attached to the keymat 12 and configured for protecting the keypads 13.

The key bodies 19 include a first key body 191 and two second key bodies 192 respectively positioned on two sides of the first key body 191. A portion of the key bodies 19 corresponding to the fitting portion 121 is attached to the cushion 17 and configured for inputting information.

Figure 2:
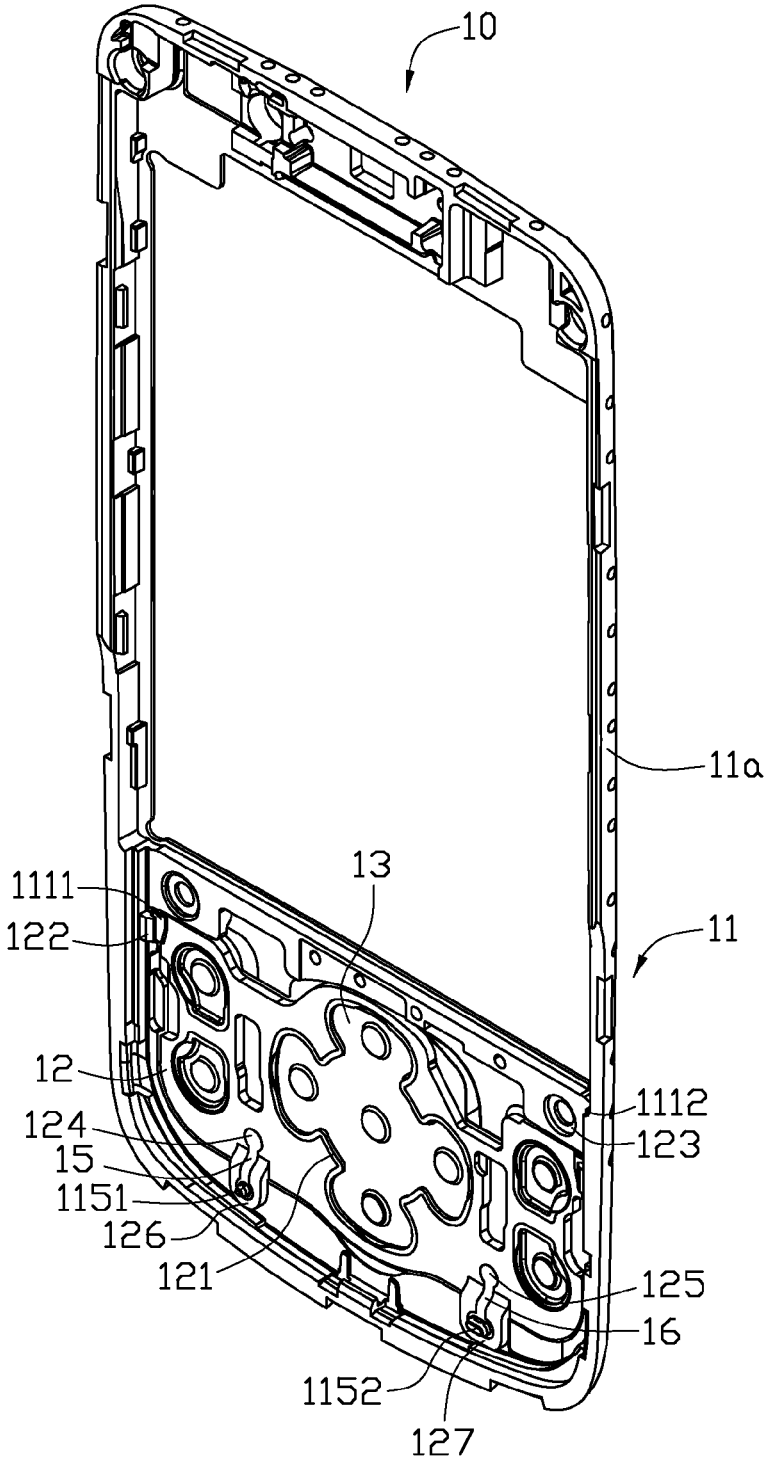
FIG. 2 is an assembled view of the keyboard structure shown in FIG. 1.

Referring to FIG. 1 and FIG. 2, in assembly, the cushion 17 is attached to one side of the keymat 12. The key bodies 19 are attached to the cushion 17. The keypads 13 are received in the fitting portion 121. The first connecting part 15 and the second connecting part 16 are respectively assembled on a side opposing to the side attaching to the cushion 17 of the keymat 12. The first clasp 122 and the second clasp 123 are respectively latched to the first slot 1111 and the second slot 1112, when the keymat 12, the keypads 13, the first connecting part 15, the second connecting part 16, the cushion 17 and the key bodies 19 are assembled on the housing 11. The first post 1151 and the second post 1152 of the fixing board 115 pass through the keymat 12. The first ring 151 and the second ring 161 respectively coils around the first post 1151 and the second post 1152.

It is to be understood that the keymat 12 can integrally formed with the keypads 13 to form a key assembly 100.

It is to be understood that the first slot 1111, the second slot 1112, the first clasp 122 and the second clasp 123 can be omitted. The key assembly 100 can be fixed on the housing 11 by the first connecting part 15 and the second connecting part 16.

It is to be understood that the first connecting portion 152 and the first protruding post 153 of the first connecting part 15, and the second connecting portion 162 and the second protruding post 163 of the second connecting part 16 can be omitted. The key assembly is then fixed on the housing 11 by the first ring 151 and the second ring 161.

The keymat 12 is fixed on the housing 11 by flexible first connecting part 15 and flexible second connecting part 16. The first connecting part 15 and the second connecting part 16 respectively coil around the first post 1151 and the second post 1152 and configure for tightly fixing the key assembly on the housing 11.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A keyboard structure, comprising:

a housing having at least one post;

a key assembly including a plurality of keypads and a keymat, the keymat defining a first through hole, a second through hole and a groove; and at least one connecting part comprising a ring, a protruding post and a connecting portion connecting the protruding post to the ring, the connecting part received in the first through hole, the second through hole and the groove, and then fixed on the keymat;

wherein the post passes through the key assembly and the ring coils around the post to connect the key assembly to the housing.

2. The keyboard structure as claimed in claim 1, wherein the housing includes a fixing board extending perpendicularly from an end wall.

3. The keyboard structure as claimed in claim 2, wherein a surface of the post has a roughened surface.

4. The keyboard structure as claimed in claim 1, wherein the protruding post is made of elastic material, the diameter of the protruding post is slightly larger than the diameter of the second through hole.

5. The keyboard structure as claimed in claim 1, wherein the housing further comprises a plurality of slots, the keymat further comprises a plurality of clasps latching to the slots.

6. The keyboard structure as claimed in claim 1, wherein the housing further comprises a plurality of key bodies attached to the keymat.

7. The keyboard structure as claimed in claim 6, wherein the key structure further comprises a cushion made of elastic material, the cushion is attached between the key bodies and the keymat.

8. An electronic device comprising:

a keyboard structure, comprising:

a housing having at least one post;

a plurality of key bodies;

a plurality of keypads;

a keymat, the key bodies attached to a first side of the keymat, the keypads attached to the keymat; and at least one connecting part assembled to a second side of the keymat, the connecting part comprising a ring;

wherein the post passes through the keymat and the ring coils around and is latched on the post to connect the keymat, the keypad and the key bodies to the housing.

9. The electronic device as claimed in claim 8, wherein the housing includes a fixing board extending perpendicularly from an end wall.

10. The electronic device as claimed in claim 8, wherein a surface of the post has a roughened surface.

11. The electronic device as claimed in claim 8, wherein the keymat defines a first through hole, a second through hole and a groove, the connecting part received in the first through hole, the second through hole and the groove, and then fixed on the keymat.

12. The electronic device as claimed in claim 11, wherein the connecting part further comprises a protruding post and a connecting portion connecting the protruding post to the ring.

13. The electronic device as claimed in claim 12, wherein the protruding post is made of elastic material, the diameter of the protruding post is slightly larger than the diameter of the second through hole.

14. The electronic device as claimed in claim 8, wherein the housing further comprises a plurality of slots, the keymat further comprises a plurality of clasps latching to the slots.

15. The electronic device as claimed in claim 8, wherein the key structure further comprises a cushion made of elastic material, the cushion is attached between the key bodies and the keymat.

* * * * *